United States Patent [19]

Reuting

[11] 4,160,222

[45] Jul. 3, 1979

[54] MONOSTABLE ELECTROMAGNETIC RELAY WITH PERMANENT MAGNETIC BIAS

[75] Inventor: Hans-Werner Reuting, Peine, Fed. Rep. of Germany

[73] Assignee: Elmeg-Elektro-Mechanik Gesellschaft mit beschränkter Haftung, Peine, Fed. Rep. of Germany

[21] Appl. No.: 812,338

[22] Filed: Jul. 1, 1977

[51] Int. Cl.[2] ..... H01H 51/22

[52] U.S. Cl. ..... 335/85; 335/78; 335/229

[58] Field of Search ..... 335/85, 227, 229, 230, 335/234, 236, 281, 78, 179, 81

[56] References Cited

U.S. PATENT DOCUMENTS 3,949,332 4/1976 Reuting ..... 335/179

4,050,043 9/1977 Reuting et al. ..... 335/234

FOREIGN PATENT DOCUMENTS 1213917 4/1966 Fed. Rep. of Germany.
1902610 12/1969 Fed. Rep. of Germany.
2318812 1/1974 Fed. Rep. of Germany.

*Primary Examiner*—Harold Broome
*Attorney, Agent, or Firm*—Smyth, Pavitt, Siegemund, Jones & Martella

[57] ABSTRACT

A relay is disclosed having two U-shaped yokes, coupled through a permanent magnet, and a coil carrying armature which may abut with the diagonally disposed legs or with the two other ones. Springs tend to move the armature from the abutment positions, but additional air gap means in two of the legs reduce the attraction so that upon turning off of the coil current the armature is always driven towards abutment with the other legs.

16 Claims, 6 Drawing Figures

MONOSTABLE ELECTROMAGNETIC RELAY WITH PERMANENT MAGNETIC BIAS

BACKGROUND OF THE INVENTION

The present invention relates to electromagnetic relays having pivotable or otherwise displaceable armatures and magnetic circuits which include permanent magnetic bias for and on the armatures to be effective particularly when the energizing current for the relay coil has been turned off.

Relays of the type referred to above are known per se. They usually are constructed so that without further provision, the armature can assume one of two stable positions following the turning off of the energizing current of the relay. However, monostable relays are also known which are constructed so that following the turning off the energizing current, the relay armature will always return to one particular position. This is commonly established through a return spring which will pull the armature into a particular disposition following the turning off of the energizing current. It must be considered, however, that this particular return spring is always effective on the armature so that whenever the armature is energized to assume a position against the force of that return spring, that return spring diminishes the contact pressure as provided by the energized armature and imparted upon the contacts actuated by it.

DESCRIPTION OF THE INVENTION

It is an object of the present invention to provide a new and improved monostable electromagnetic relay.

It is a specific object of the present invention to improve a relay constructed to have a movable armature energizable by coil means, and having two permanent-magnetically biased magnetic circuits both of them including the coil means and running through the armature and each of them has at least one pole shoe, the armature can be placed in abutment with either of the pole shoes; moreover the relay is to have armature-actuated, spring-biased contacts whereby for example, the contact pressure results from biased reflection of the springs by means of the armature so that the springs, in turn, tend to move the armature out of the abutment positions.

In accordance with the preferred embodiment of the present invention, it is suggested to provide the magnetic impedance of one of these magnetic circuits so that the armature, when in abutment with the one pole shoe of that circuit, is attracted through the permanent magnetic bias towards that one pole shoe to a lesser degree than contact spring means tend to remove the armature from that abutment position. This way, the armature will always be placed into abutment position with the other one of the two pole shoes as soon as the energizing current through the coil has been turned off.

It can thus be seen that for practicing the invention, it is not necessary to provide a special return spring. Also, existing bi-stable relays can readily be modified and changed into monostable relays, by increasing the magnetic impedance for one position. The magnetic impedance or reluctance can be increased in a variety of ways. For example, one may take a relay construction of the bistable variety and provide the one pole shoe with an additional cutout and fill it with plastic so that air gap means are, in fact, added to the extent necessary so that the magnetic extraction towards that pole shoe is made smaller than the oppositely acting spring force. This additional air gap means can be provided anywhere in the particular magnetic circuit. Alternatively, one may increase the magnetic impedance by chosing smaller or physically reducing the dimensions in the cross section for one of the magnetic circuits. Local saturation increases the reluctance sufficiently for purposes of the invention.

The magnetic attraction force driving the armature towards that particular pole shoe varies, of course, with the distance therefrom; the spring reaction force is likewise distance dependent. In order to operate with a fairly large margin of safety, the parameters can be chosen so that the repelling spring force is larger everywhere than the magnetic attraction force, to drive the armature with certainty towards the other pole shoe. However, it is sufficient in principle to provide for a smaller magnetic attraction only as long as the armature has or passes through positions in the immediate vicinity of the pole shoe, so that upon turning off of the relay energizing current, the spring force kicks the armature away; the resulting kinetic must then be sufficient to propel the armature out of any range in which the magnetic attraction is a little larger than the repelling spring force.

A particular and preferred embodiment includes altogether four poles and a swivel armature whose ends may be in abutment with respective two diagonally opposed poles or pole shoes. Two of these pole shoes may be provided with any of the means which increase the reluctance.

The permanent magnetic bias may be established through a true permanent magnet, but it is possible in principle to establish a permanent bias through constant current auxiliary magnetization. Also, it is conceivable to establish the desired relation between attraction and spring force by using differently strong springs.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a relay having two U-shaped yoke elements 1 and 2 being disposed in parallel to each other so that all legs extend in parallel. The legs of the U are constructed and serve as pole shoes, 3 and 4, of yoke 1; and 5 and 6 of yoke 2. A swivel or pivot armature 7 is disposed between the legs of the U's whereby the pole shoes 3 through 6 serve also as abutment stops for the armature.

Assuming for a moment that the relay were a bistable one, then the armature will basically assume one of two stable positions whereby each position is defined by a position of abutment of the armature ends to two diagonally opposed pole shoes. Thus, in one stable position the armature ends abut pole shoes 3 and 6, and in the other stable position the armature ends abut pole shoes 4 and 5. The armature 7 is shown in an intermediate position in which its ends have equal distance from pole shoes; this is not a stable position.

Figure 1:
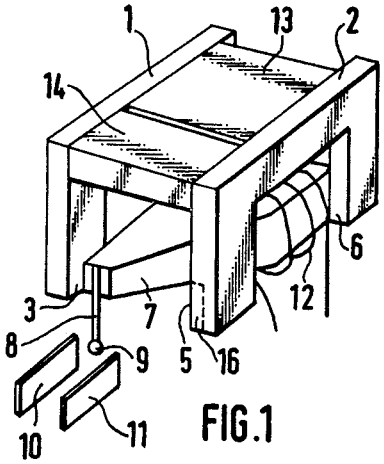
FIG. 1 is a perspective view of a relay constructed in accordance with the preferred embodiment of the present invention.

The armature 7 carries an actuator pin 8 on one of its ends which is the front end in the illustration of FIG. 1. A glass ball is carried by the tip of pin 8. The actuator pin 8 and particularly the glass ball 9 operate contact springs 10 and 11 upon deflection of the armature 7 in one or the other direction from the position illustrated in FIG. 1. The actuator is in the middle, between the contact springs 10, 11 when the armature is in a position of non abutment, between the pole shoes and at equal distances therefrom. However, when the armature 7 is in abutment with pole shoe 3, contact spring 10 is deflected, tending to move the armature 7 away from the pole shoe; when armature 7 is in abutment with pole shoe 5, spring 11 is deflected, tending to move the armature 7 away from that pole shoe. Hence, the springs impart a destabilizing effect upon the armature.

The armature 7 is looped by a coil 12 in order to provide the magnetic system with an electromagnetically produced magnetic field. The bottom portion of the two U-shaped yokes 1 and 2 are interconnected by means of a permanent magnet 13 which is additionally shunted by means of a magnetic shunt 14. Depending upon the electric current flow in coil 12, armature 7 can be pivoted from either of the two stable positions as defined above into the respective other one. In order to change the position, the flux produced electromagnetically must overcome the permanent magnetic bias being effective as attraction for the armature 7 to maintain its position. The armature, therefore is common to two magnetic circuits and may complete either of them depending upon its position. Each circuit includes and is biased by the permanent magnet. One circuit includes part of yoke 1, pole shoe 3, armature 7 when in abutment with pole shoe 3, pole shoe 6 and part of yoke 2. The other circuit includes part of yoke 1, pole shoe 4, armature 7 (assumed in the other position), pole shoe 5 and part of yoke 2. In each of these positions armature 7 is attracted magnetically towards the pole shoe against which it abuts. Whether or not these are actually stable positions depends on the relation of the attraction to the destabilizing effect of the deflected springs.

Figure 2:
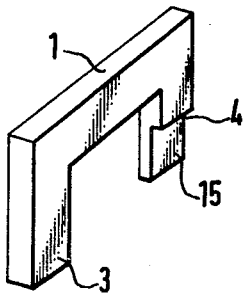
FIG. 2 is a perspective view of a yoke part used in the relay in FIG. 1.
Figure 2A:
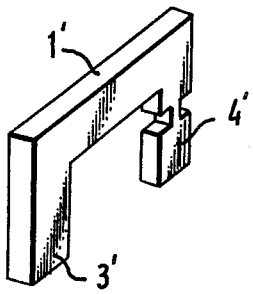
FIG. 2*a* is a perspective view of a modified yoke part.

The two pole shoes 4 and 5 each have a recess, 15 and 16 respectively, and disposed for example, in the region of the respective area of abutment with the armature. The yokes 1 and 2 are jacketed in a plastic cover at least in the regions of the pole shoes 3 through 6. However, the recesses 15 and 16 are filled with plastic so that layer is considerably thicker in these particular areas. FIG. 2 illustrates the recess 15 without the filling and FIG. 1 can be interpreted as illustrating the pole shoes as being coiled with plastic so that the recess 16 as such is no longer visible and the particular leg contour appears from the outside as if there were no recess.

As will be explained with reference to FIGS. 3 to 5, this particular relay has the inherent property that upon turning off of the current in coil 12 armature 7 will always assume a disposition in which its ends abut the pole shoes 3 and 6. Basically, this is the result of creating additional air gaps in these insulation filled recesses 15 and 16 so that the magnetic flux as produced by the permanent magnet 13 is reduced in the poles 4 and 5, and the attraction of the armature by and towards these pole shoes is diminished. The magnetic reluctance in this circuit is increased to such an extent that the deflection of contact spring 11 imparts a force upon armature 7 when in abutment with poles 4 and 5 which force is larger than the magnetic force tending to attract the armature towards poles 4 and 5.

If for reasons of a particular energization of the armature 7 by coil 12, the armature 7 is forced into a position of abutment with the poles 4 and 5 then upon turning off of the current, the force of spring 11 kicks the armature towards the other position, and even before passing through the center position (illustrated in FIG. 1), the magnetic attraction from the poles 3 and 6 will cause the armature to assume a position of abutment with these pole shoes. The situation is different as far as that position of abutment is concerned. The magnetic attraction provided by the pole shoes 3 and 6 is larger than the spring force of deflected spring 10 tending to deflect the armature. Thus, the relay is monostable indeed.

Figure 3:
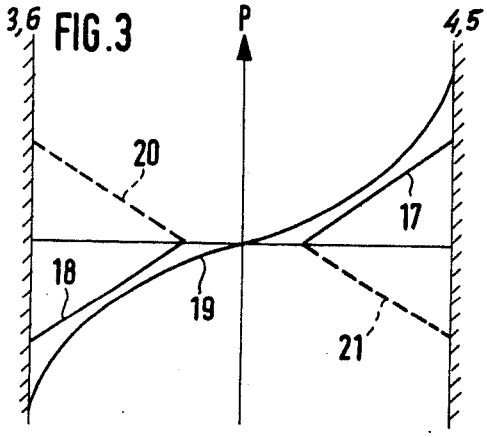
FIGS. 3 to 5 are force-displacements for comparing the permanent magnet force and spring contact forces in a (FIG. 3) known relay, a modified relay (FIG. 4) as well as in a relay (FIG. 5) in accordance with the preferred embodiment.

FIG. 3 illustrates the permanent magnetic force (curve 19) as well as spring forces (curves 20 and 21) as they are effective on the armature in between the two positions of abutment. Therefore, the abscissa in FIG. 3 as well as in FIGS. 4 and 5 represents points of distance or displacement of the armature ends from positions of abutment. The center position is a position in which the armature is equally far from the pole shoes 3 and 5, or 4 and 6. The vertical lines to the left and to the right represent respectively the two abutment positions on pole shoes 3, 6 and 4, 5. The ordinate represents force in all three figures.

FIG. 3 now illustrates the relation or forces, not for the particular relay shown in FIG. 1, but for a relay in which the cut outs 15 and 16 are not provided. In other words, FIG. 3 is the force-displacement diagram for the armature of a bi-stable relay. See also for example my U.S. Pat. No. 3,949,332. The diagram assumes a linear spring force, and the points where the spring forces (20 or 21) reach zero are the points in the armature displacement diagram where the ball 9 disengages from spring 10 or from spring 11.

FIG. 3 teaches generally that the spring force is never larger than the magnetic force of attraction for the armature and provided through the permanent magnetic energization so that the spring force is never able to overcome the attraction provided by the permanent magnetization bias. Spring force and permanent magnet force, of course, act in opposite direction. However, in order to facilitate the analysis and the comparison of the relevant magnitudes of the forces, the mirror images of the spring force curves have been plotted, which are the characteristics 17 and 18. One can see that, in terms of magnitude, the spring forces are in fact always smaller than the permanent magnet forces. This is particularly true with regard to either abutment position in which the permanent magnet force then effective is considerably higher than the force exerted by the spring upon the armature tending to deflect the armature away from the respective position of abutment.

Also, one can see from FIG. 3 that if there are no cutouts in any of the legs or pole shoes, the force displacement diagrams are (or should be) perfectly symmetrical. In other words, there is no preferred position for the armature, so that the relay is in fact bi-stable.

Figure 4:
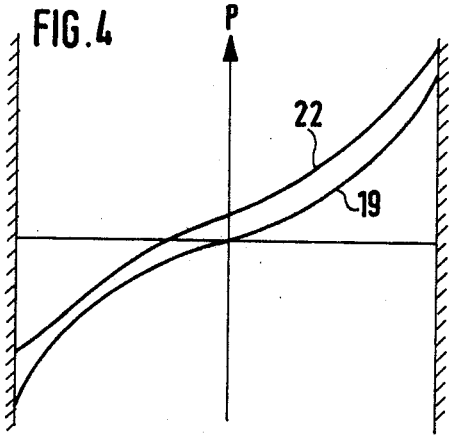

FIG. 4 illustrates a hypothetical case. The relay is still assumed not to have cut-outs such as 15 and 16, but could be made into a monostable relay by using an additional spring. This particular spring would have a mirror image spring force 22 and would in fact insure that; whenever armature current is turned off, the armature will always be moved by this additional spring force into a position which, as far as FIG. 4 is concerned, is the left-hand position of abutment. This is so because for more than half of the range the spring force tending to drive the armature into the left-hand position of abutment is larger than the permanent magnet force of attraction for pole shoes 4, 5. However, beyond the center point the spring force is added to the attraction. At some point the spring force will reverse, but then the magnetic attraction towards pole shoes 3 and 6 prevails, to drive the armature into the position of abutment with these pole shoes.

Figure 5:
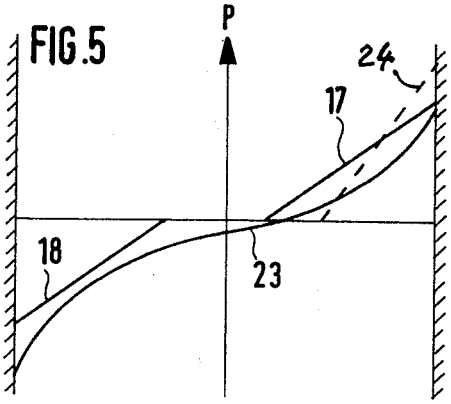

FIG. 5 now illustrates the force-displacement diagram as it has validity for the relay in accordance with the actual construction shown in FIGS. 1 and 2. The spring forces are represented by the mirror image curves 17 and 18 and are the same as per FIG. 3. However, the magnetic attraction is rendered asymmetrical through the additional cut outs 15 and 16 increasing the air gap for the magnetic circuit which includes the pole shoes 4 and 5. The magnetic attraction is reduced to such an extent that the permanent magnet force acting on armature 7 as per curve 23 remains below the mirror image spring force 17 throughout the displacement region between the center position and the position of abutment with pole shoes 4 and 5. This spring force 17 is, or course, provided by a spring 11. This means that whenever the armature has a disposition in which its ends are in abutment with the legs 4 and 5, or is near that position, the force exerted by spring 11 exceeds the magnetic force of attraction as provided by the permanent magnet through the air gaps 15 and 16 so that in fact the armature is driven in a direction which, as per FIG. 5, is a direction to the left.

It should be mentioned that the preferred embodiment of the invention includes the two yokes and two legs so that the armature is in a position of abutment in each stable position with two oppositely disposed legs. However, this is not essential in principle. The armature may, for example, swivel or pivot just with one end, and from abutment of that one end with one pole shoe leg or with the other pole shoe leg, and one of these legs is then provided with a cut out and a non-magnetic filler to establish an air gap; such a construction suffices in order to establish the asymmetry in the force-displacement diagram as shown in FIG. 5.

FIG. 5 illustrates moreover a situation under most favorable operations conditions of adjustment and dimensioning. The optimum conditions do require that, in fact, the spring force exceeds the magnetic attraction force everywhere in that half of the air gap and armature displacement path which is closer to the leg or legs having a plastic-filled cutout. In practice, however, it may well suffice that the spring force exceeds the permanent magnet force in the position of abutment with pole shoes 4 and 5 and in smaller distances from these pole shoes, while in larger distances, the force of spring 11 could become smaller than the magnetic force of attraction. Dotted line 24 represents such a spring having in effect a shorter deflection range but being stiffer. This is still a permissable situation because one always starts with a position of abutment. If the armature 7 assumed a position of abutment with pole shoes 4 and 5 on account of electromagnetic energization, and after the current has been turned off, a rather large spring force is available to overcome the smaller permanent magnet force effective on the abutting armature, and this is true for a certain range of distances of the armature from these particular yoke legs. Therefore, the armature 7 will be pushed and receives a certain amount of kinetic energy. At the point where the spring force 24 intersects the magnet force 23, the force of attraction tending to drive the armature back towards poles 4, 5 will turn to become larger than the accelerating spring force, but that will still not cause the armature to reverse; it will merely slow the armature down and once the point where the magnetic attraction force reverses its direction has been reached attraction in the opposite direction takes over, just as described, to drive the armature towards pole shoes 3 and 6.

It will be appreciated that the invention is not limited to the particular type of relay illustrated in FIG. 1. The invention is applicable to all bistable relays in which, one the basis of the magnetic circuit, the armature has two stable positions established and maintained through a permanent magnet. The invention merely requires that the magnetic attraction towards one of these positions be reduced, e.g. through insertion or enlargement of an air gap, so that for that particular position the relay spring force is able to overcome the magnetic attraction whenever such attraction is exclusively established by the permanent magnet. The plastic filled cut outs as described are quite convenient and from a standpoint of manufacturing, constitute a simple solution to the problem of making a monostable relay. The particular location of this additional magnetic impedance (reluctance) may well be chosen differently. One could also reduce the dimension of one or two legs as shown for pole shoes 4' in FIG. *2a*. The constriction may be chosen so that the constriction saturates, which increases the magnetic resistance through that constriction significantly. Still alternatively one could make these particular legs having the pole shoes 4 and 5 from a material which is a much poorer conductor.

In all of these instances one will obtain a situation in which the armature tending to complete a magnetic circuit by being attracted, will be subjected to a spring force of sufficient strength for driving the armature away from that position of abutment and to the opposite position so that whenever the electric current is turned off the relay will with certainty assume one and only one particular position.

The invention is not limited to the embodiments described above but all changes and modifications thereof not constituting departures from the spirit and scope of the invention are intended to be included.

I claim:

1. In an electromagnetic relay having two magnetic circuits which include respectively at least one pole shoe per circuit, permanent magnet means common to the two circuits and being coupled to the pole shoes, an armature movably disposed to assume positions of abutment with one or the other one of the two pole shoes thereby completing respectively a first one and a second one of the two magnetic circuits, the relay having in addition spring contact means, the armature being provided with means for engaging the spring contact means, the relay further being provided with coil means to obtain electromagnetic energization to place the armature into a position of abutment with one or the other one of the pole shoes depending upon the direction of the electromagnetic energization, said spring contact means being biased in said positions of abutment tending to move said armature out of either of said positions of abutment, the improvement comprising:

the magnetic reluctance of the first circuit being larger than the magnetic reluctance of the second circuit and said spring contact means providing a force exceeding the magnetic attraction of the armature in a position of abutment for completing the first circuit to place the armature always in a position to complete said second circuit upon de-energization of the coil means irrespective of the position the armature had immediately preceding the de-energization of the coil means.

2. In a relay as in claim 1, first and second circuits differing in cross-section so that said reluctances being different through differences in the said cross-sections of the circuits.

3. In a relay as in claim 1, said magnetic reluctances being different by inclusion of an air gap in one of the circuits and not in the other one.

4. In a relay as in claim 3, said additional air gap being provided as a cut out in one of the pole shoes.

5. A monostable electromagnetic relay comprising:

first pole shoe means;

second pole shoe means spaced apart from the first pole shoe means to define a displacement path;

an armature mounted for displacement and having a portion to be placed in abutment with the first or the second pole shoe means;

a permanent means connected to the first and the second pole shoe means, so that a first magnetic circuit is completed when the armature abuts the first pole shoe means and a second magnetic circuit is completed when the armature abuts the second pole shoe means;

coil means disposed to obtain magnetic energization of the armature so as to oppose or to reinforce an effective magnetic bias as resulting from the permanent magnet means, depending upon the direction of magnetization as provided by the energization of the coil means;

spring means disposed for being actuated by the armature and tending to move the armature away from the positions of abutment; and means included in the first magnetic circuit to diminish the magnetic attraction of the armature against the first pole shoe means so that the armature is always moved by the springs means into abutment with the second pole shoe means upon de-energization of the coil means.

6. A relay as in claim 5, said means being an additional air gap.

7. A relay as in claim 5, said means being a recess in the first pole shoe means.

8. A relay as in claim 7, said recess being filled with insulation material.

9. A relay as in claim 5, said means being a constriction in the first magnetic circuit.

10. A relay as in claim 9, said constriction providing situation of the constricted portion.

11. A monostable electromagnetic relay comprising:

a permanent magnet means;

a first magnetic circuit including a first pole shoe means coupled to the permanent magnet means; a second magnetic circuit including a second pole shoe means also coupled to the permanent magnet means, said first circuit having higher magnetic reluctance than the second circuit;

an armature pivotally disposed to assume positions of abutment with the first or the second pole shoe means;

actuating means coupled to the armature and moving therewith;

coil means electromagnetically coupled to the armature tending to move the armature into abutment with the first of the second pole shoe means depending upon the direction of magnetization provided by the current flow through the coil means;

spring contact means disposed to be engaged and operated by the actuation means and providing forces tending to move the armature from the abutment positions; and the force as provided by the spring contact means exceeds the attraction provided by the first magnetic circuit including the first pole shoe means upon the armature when the armature is in abutment with the first pole shoe means on account of said higher reluctance while the coil means is de-energized, the force provided by the spring contact means is smaller than the attraction provided by the second magnetic circuit including the second pole shoe means upon the armature when the armature is in abutment with the second pole shoe means and the coil means is de-energized.

12. A relay as in claim 11, said second circuit means as coupled to the permanent magnet means exhibiting a large magnetic reluctance than the first circuit means as coupled to the permanent magnet means.

13. A relay as in claim 12, said second pole shoe means having a recess filled with non-magnetic material.

14. A relay as in claim 12, said second pole shoe means coupled to the permanent magnet means through a saturating path.

15. A relay as in claim 11, said spring means having a force-displacement characteric so that the force it provides for overcoming the attraction of the armature towards the first pole shoe means is larger than the attraction independant form the displacement.

16. An electomagnetic relay comprising: a first U-shaped yoke;

a second U-shaped yoke, each said yokes having a base portion from which extend two legs;

a permanent magnet coupling the two base portions together;

an armature disposed for pivotal displacement and for abutment either with two diametrically opposed legs of said two yokes or with the respective two other legs of the yokes;

at least one of the legs including air gap defining means to diminish the magnetic flux through the one leg;

coil means coupled to the armature to provide magnetic energization in a direction depending upon the direction of energization of the coil means; and spring contact means for tending to move the armature from the abutment position thereby overcoming an attraction of the armature towards the two legs but not towards the two other legs, so that upon de-energization of the coil means the armature is moved by the spring contact means into abutment with the two legs regardless of the position the armature had upon de-energization of the coil means.

* * * * *